United States Patent [19]

Borsenberger et al.

[11] Patent Number: 4,578,334

[45] Date of Patent: Mar. 25, 1986

[54] MULTI-ACTIVE PHOTOCONDUCTIVE INSULATING ELEMENTS AND METHOD FOR THEIR MANUFACTURE

[75] Inventors: Paul M. Borsenberger, Hilton; Michael T. Regan; William J. Staudenmayer, both of Pittsford, all of N.Y.

[73] Assignee: Eastman Kodak Company, Rochester, N.Y.

[21] Appl. No.: 674,197

[22] Filed: Nov. 23, 1984

[51] Int. Cl.[4] ..... G03G 5/06; G03G 5/14

[52] U.S. Cl. ..... 430/59; 430/58; 430/72; 430/78

[58] Field of Search ..... 430/58, 59, 72, 76, 430/78

[56] References Cited

U.S. PATENT DOCUMENTS

| | | | |
|---|---|---|---|
| 3,871,882 | 3/1975 | Wiedemann | 430/59 |
| 3,904,407 | 9/1975 | Regensburger et al. | 430/58 |
| 3,972,717 | 8/1976 | Wiedemann | 430/65 |
| 4,410,615 | 10/1983 | Goto et al. | 430/59 |
| 4,419,427 | 12/1983 | Graser et al. | 430/58 |
| 4,429,029 | 1/1984 | Hoffmann et al. | 430/57 |
| 4,517,270 | 5/1985 | Graser et al. | 430/58 |

FOREIGN PATENT DOCUMENTS

| | | | |
|---|---|---|---|
| 3019326 | 3/1983 | Fed. Rep. of Germany . | |
| 55-36849 | 3/1980 | Japan | 430/58 |

*Primary Examiner*—Roland E. Martin

*Attorney, Agent, or Firm*—Alfred P. Lorenzo

[57] ABSTRACT

Multi-active photoconductive insulating elements which exhibit very high electrophotographic speed and panchromatic sensitivity, and whose manufacture can be effectively controlled to provide an electrical contrast ranging from a very low to a very high level, are comprised of a charge-generation layer and a charge-transport layer in electrical contact therewith and contain, as the charge-generating agent within the charge-generation layer, certain crystalline forms of N,N'-bis(2-phenethyl)perylene-3,4:9,10-bis(dicarboximide) characterized by particular spectral absorption and X-ray diffraction characteristics. The charge-generation layer is capable, upon exposure to activating radiation, of highly effective generation and injection of charge carriers and the charge-transport layer, which is comprised of an organic composition containing an organic photoconductive material, is capable of accepting and transporting the injected charge carriers to thereby form a highly advantageous multi-active photoconductive insulating element.

22 Claims, 7 Drawing Figures

MULTI-ACTIVE PHOTOCONDUCTIVE INSULATING ELEMENTS AND METHOD FOR THEIR MANUFACTURE

FIELD OF THE INVENTION

This invention relates in general to electrophotography and in particular to novel multi-active photoconductive insulating elements which are useful therein. More specifically, this invention relates to novel multi-active photoconductive insulating elements which exhibit very high electrophotographic speed and panchromatic sensitivity and whose manufacture can be effectively controlled to provide an electrical contrast ranging from a very low to a very high level.

BACKGROUND OF THE INVENTION

Electrophotographic imaging processes and techniques have been extensively described in both the patent and other literature, for example, U.S. Pat. Nos. 2,221,776; 2,277,013; 2,297,691; 2,357,809; 2,551,582; 2,825,814; 2,833,648; 3,220,324; 3,220,831; 3,220,833 and many others. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a permanent record of the charge image.

Various types of photoconductive insulating elements are known for use in electrophotographic imaging processes. In many conventional elements, the active components of the photoconductive insulating composition are contained in a single layer composition. This layer is coated on a suitable electrically-conductive support or on a non-conductive support that has been overcoated with an electrically-conductive layer.

Among the many different kinds of photoconductive compositions which may be employed in typical single-active-layer photoconductive elements are inorganic photoconductive materials such as vacuum-deposited selenium, particulate zinc oxide dispersed in a polymeric binder, homogeneous organic photoconductive compositions composed of an organic photoconductor solubilized in a polymeric binder, and the like.

Other especially useful photoconductive insulating compositions which may be employed in a single-active-layer photoconductive element are the high-speed heterogeneous or aggregate photoconductive compositions described in Light, U.S. Pat. No. 3,615,414 issued Oct. 26, 1971 and Gramza et al, U.S. Pat. No. 3,732,180 issued May 8, 1973. These aggregate-containing photoconductive compositions have a continuous electrically-insulating polymer phase containing a finely-divided, particulate, co-crystalline complex of (i) at least one pyrylium-type dye salt and (ii) at least one polymer having an alkylidene diarylene group in a recurring unit.

In addition to the various single-activelayer photoconductive insulating elements, such as those described above, various multi-active photoconductive insulating elements, that is, elements having more than one active layer, are also well known and, in general, are capable of providing superior performance. In such multi-active elements, at least one of the layers is designed primarily for the photogeneration of charge carriers and at least one other layer is designed primarily for the transportation of these generated charge carriers. Representative examples of patents describing such multi-active photoconductive insulating elements include the following:

Bardeen, U.S. Pat. No. 3,041,166, issued June 26, 1962,

Hoesterey, U.S. Pat. No. 3,165,405, issued Jan. 12, 1965,

Makino, U.S. Pat. No. 3,394,001, issued July 23, 1968,

Makino et al, U.S. Pat. No. 3,679,405, issued July 25, 1972,

Hayaski et al, U.S. Pat. No. 3,725,058, issued Apr. 3, 1973,

Wiedemann, U.S. Pat. No. 3,871,882, issued Mar. 18, 1975,

Regensburger et al, U.S. Pat. No. 3,904,407, issued Sept. 9, 1975,

Wiedemann, U.S. Pat. No. 3,972,717, issued Aug. 3, 1976,

Mey, U.S. Pat. No. 4,108,657, issued Aug. 27, 1978,

Berwick et al, U.S. Pat. No. 4,175,960, issued Nov. 27, 1979.

Smith et al, U.S. Pat. No. 4,282,298, issued Aug. 4, 1981,

Wiedemann, German Patent Application No. 3 019 326, published Dec. 3, 1981,

Graser et al, European Patent Application No. 0 061 088, published Sept. 29, 1982 (corresponding to U.S. Pat. No. 4,517,270, issued May 14, 1985).

Goto et al, U.S. Pat. No. 4,410,615, issued Oct. 18, 1983,

Graser et al, U.S. Pat. No. 4,419,427, issued Dec. 6, 1983, and

Hoffmann et al, U.S. Pat. No. 4,429,029, issued Jan. 31, 1984.

However, multi-active elements of the prior art have typically suffered from one or more disadvantages which have significantly restricted their commercial utilization. For example, they have not exhibited sufficiently high electrophotographic speed, or have lacked a sufficiently broad range of sensitivity, or have been incapable of providing desired contrast characteristics, or have suffered from excessive photoinduced fatigue or from reciprocity failure or from too high a rate of dark decay, or have exhibited excessive electrical noise.

It is toward the objective of overcoming the aforesaid disadvantages of multi-active photoconductive insulating elements that the present invention is directed.

SUMMARY OF THE INVENTION

In accordance with this invention, a multi-active photoconductive insulating element is comprised of a charge-generation layer and a charge-transport layer in electrical contact therewith and contains, as the charge-generating agent within the charge-generation layer, a particular crystalline form of N,N'-bis(2-phenethyl)-perylene-3,4:9,10-bis(dicarboximide), as hereinafter described in full detail, that provides a combination of very high electrophotographic speed and panchromatic sensitivity. The charge-generation layer is characterized by (1) a first spectral absorption peak within the range of 420 to 470 nm and a second spectral absorption peak within the range of 610 to 630 nm, and (2) a prominent line at a 20 angular position within the range of 22 to 25 degrees in the X-ray diffraction pattern obtained with CuK $\alpha$ radiation. The charge-transport layer is comprised of an organic composition containing an organic photoconductive material which is capable of accepting and transporting charge carriers injected from the charge-generation layer. Appropriate control of the procedures used in preparation of the charge-generation and charge-transport layers, in a manner hereinafter described in full detail, enables the manufacture of an element with a desired level of electrical contrast, ranging from very low contrast to very high contrast.

The invention also comprises a method of preparing the aforesaid multi-active photoconductive insulating elements which comprises depositing a substantially amorphous layer of N,N'-bis(2-phenethyl)perylene-3,4:9,10-bis(dicarboximide) on an electrically-conductive support and overcoating the amorphous layer with a liquid composition which functions to both form a charge-transport layer and penetrate into the amorphous layer to convert the N,N'-bis(2-phenethyl)perylene-3,4:9,10-bis(dicarboximide) to the desired crystalline form.

DESCRIPTION OF THE PREFERRED EMBODIMENTS

Figure 1:
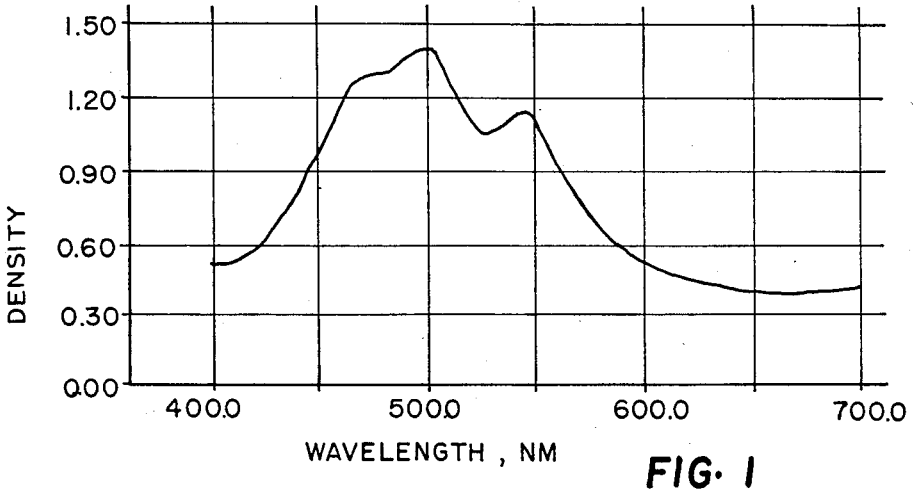
FIG. 1 is a plot of the spectral absorption curve of an amorphous layer of vacuum-deposited N,N'-bis(2-phenethyl)perylene-3,4:9,10-bis(dicarboximide).

The compound N,N'-bis(2-phenethyl)perylene-3,4:9,10-bis(dicarboximide), which is referred to hereinafter for convenience as PPC, exhibits polymorphism, that is, it is capable of existing in various crystalline forms, as well as in an amorphous form. More specifically, it has been found that PPC is capable of existing in at least five different crystalline forms which can be described, in relation to the X-ray diffraction pattern obtained with CuK$\alpha$ radiation, as the 5.5°, 6°, 6.2°, 3° and 24° forms. In this invention, the crystalline forms employed provide a charge-generation layer having an X-ray diffraction pattern, obtained with CuK$\alpha$ radiation, that is characterized by a prominent line at a $2\theta$ angular position within the range of 22 to 25 degrees. A particular crystalline form, referred to herein for convenience as the 23° form, is utilized to achieve a multi-active photoconductive insulating element with a particularly advantageous combination of characteristics, namely, very high electrophotographic speed, panchromatic sensitivity, and low electrical contrast. A second crystalline form, referred to herein for convenience as the 24° form, is utilized to achieve a multi-active photoconductive insulating element that combines very high electrophotographic speed, panchromatic sensitivity, and high electrical contrast.

Certain of the multi-active photoconductive insulating elements described heretofore, for example, those of the Regensburger et al, Wiedemann, Graser et al, Goto et al, and Hoffmann et al patents identified hereinabove, have utilized perylene pigments as the charge-generating agent of the charge-generation layer. However, the elements of this invention are distinctly different from those of the prior art in that they utilize a particular perylene pigment, namely PPC, in particular crystalline forms—characterized herein by reference to spectral absorption and X-ray diffraction characteristics—which have been unexpectedly found to provide a unique combination of desirable electrophotographic characteristics, including very high electrophotographic speed, panchromatic sensitivity, low dark decay, and controllable contrast.

The novel multi-active photoconductive insulating elements of this invention have at least two active layers, namely a charge-generation layer in electrical contact with a charge-transport layer. The charge-generation layer is capable, upon exposure to activating radiation, of generating and injecting charge carriers into the charge-transport layer. The charge-transport layer is an organic composition comprising, as a charge-transport agent, an organic photoconductive material which is capable of accepting and transporting injected charge carriers from the charge-generation layer.

The term "activating radiation" as used herein is defined as electromagnetic radiation which is capable of generating electron-hole pairs in the charge-generation layer upon exposure thereof.

The charge-generation and charge-transport layers are typically coated on an "electrically-conductive support", by which is meant either a support material which is electrically-conductive itself or a support material comprised of a non-conductive substrate coated with a conductive layer. The support can be fabricated in any suitable configuration, such as that of a sheet, a drum or an endless belt. Exemplary "electrically-conductive supports" include paper (at a relative humidity above 20 percent); aluminum-paper laminates; metal foils such as aluminum foil, zinc foil, etc.; metal plates or drums, such as aluminum, copper, zinc, brass and galvanized plates or drums; vapor deposited metal layers such as silver, chromium, nickel, aluminum and the like coated on paper or conventional photographic film bases such as cellulose acetate, poly(ethylene terephthalate) polystyrene, etc. Such conducting materials as chromium, nickel, etc., can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers, both with and without electrical barrier layers, are described in U.S. Pat. No. 3,245,833 by Trevoy, issued Apr. 12, 1966. Other useful conducting layers include compositions consisting essentially of an intimate mixture of at least one inorganic oxide and from about 30 to about 70 percent by weight of at least one conducting metal, e.g., a vacuum-deposited cermet conducting layer as described in Rasch, U.S. Pat. No. 3,880,657, issued Apr. 29, 1975. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk, issued Nov. 7, 1961 and 3,262,807 by Sterman et al, issued July 26, 1966.

The charge-transport layer utilized in the elements of this invention can include a very wide variety of organic materials which are capable of transporting charge carriers generated in the charge-generating layer. Most charge transport materials preferentially accept and transport either positive charges (holes) or negative charges (electrons), although there are materials known which will transport both positive and negative charges. Transport materials which exhibit a preference for conduction of positive charge carriers are referred to as p-type transport materials, whereas those which exhibit a preference for the conduction of negative charges are referred to as n-type.

Where it is intended that the charge-generation layer be exposed to actinic radiation through the charge-transport layer, it is preferred that the charge-transport layer have little or no absorption in the region of the electromagnetic spectrum to which the charge-generation layer responds, thus permitting the maximum amount of actinic radiation to reach the charge-generation layer. Where the charge-transport layer is not in the path of exposure, this consideration does not apply.

In addition to the essential charge-generation and charge-transport layers, the multi-active photoconductive insulating elements of this invention can contain various optional layers, such as subbing layers, overcoat layers, barrier layers, and the like.

In certain instances, it is advantageous to utilize one or more adhesive interlayers between the conducting substrate and the active layers in order to improve adhesion to the conducting substrate and/or to act as an electrical barrier layer as described in Dessauer, U.S. Pat. No. 2,940,348. Such interlayers, if used, typically have a dry thickness in the range of about 0.1 to about 5 microns. Typical materials which may be used include film-forming polymers such as cellulose nitrate, polyesters, copolymers of poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. A partial list of representative vinylidene chloride-containing polymers includes vinylidene chloride-methyl methacrylateitaconic acid terpolymers as disclosed in U.S. Pat. No. 3,143,421. Various vinylidene chloride containing hydrosol tetrapolymers which may be used include tetrapolymers of vinylidene chloride, methyl acrylate, acrylonitrile, and acrylic acid as disclosed in U.S. Pat. No. 3,640,708. A partial listing of other useful vinylidene chloride-containing copolymers includes poly(vinylidene chloride-methyl acrylate), poly(vinylidene chloride-methacrylonitrile), poly(vinylidene chloride-acrylonitrile), and poly(vinylidene chloride-acrylonitrile-methyl acrylate). Other useful materials include the so-called "tergels" which are described in Nadeau et al, U.S. Pat. No. 3,501,301.

One especially useful interlayer material which may be employed in the multi-active element of the invention is a hydrophobic film-forming polymer or copolymer free from any acid-containing group, such as a carboxyl group, prepared from a blend of monomers or prepolymers, each of said monomers or prepolymers containing one or more polymerizable ethylenically unsaturated groups. A partial listing of such useful materials includes many of the above-mentioned copolymers, and, in addition, the following polymers: copolymers of polyvinylpyrrolidone and vinyl acetate, poly(vinylidene chloride-methyl methacrylate), and the like.

Optional overcoat layers may be used in the present invention, if desired. For example, to improve surface hardness and resistance to abrasion, the surface layer of the multi-active element of the invention may be coated with one or more electrically insulating, organic polymer coatings or electrically insulating, inorganic coatings. A number of such coatings are well known in the art and, accordingly, extended discussion thereof is unnecessary. Typical useful overcoats are described, for example, in *Research Disclosure,* "Electrophotographic Elements, Materials, and Processes", Volume 109, page 63, Paragraph V, May, 1973, which is incorporated by reference herein.

The essential component of the charge-generation layer in the novel photoconductive elements of this invention is PPC in a particular novel crystalline form as hereinbefore described.

PPC can be represented by the following structural formula:

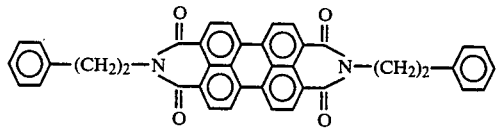

In preparing the novel multi-active photo-conductive insulating elements of this invention, the PPC is deposited in the form of an amorphous layer and is thereafter converted to the desired crystalline form.

As indicated hereinabove, the second of the essential layers of the multi-active photoconductive insulating elements of this invention is a charge-transport layer. This layer comprises a charge-transport material which is an organic photoconductive material that is capable of accepting and transporting injected charge carriers from the charge-generation layer. The organic photoconductive material can be a p-type material, that is a material which is capable of transporting positive charge carriers, or an n-type material, that is a material which is capable of transporting negative charge carriers. The term "organic", as used herein, is intended to refer to both organic and metallo-organic materials.

Illustrative p-type organic photoconductive materials include:

1. carbazole materials including carbazole, N-ethyl carbazole, N-isopropyl carbazole, N-phenylcarbazole, halogenated carbazoles, various polymeric carbazole materials such as poly(vinyl carbazole) halogenated poly(vinyl carbazole), and the like.

2. arylamine-containing materials including monoarylamines, diarylamines, triarylamines, as well as polymeric arylamines. A partial listing of specific arylamine organic photoconductors includes the particular non-polymeric triphenylamines illustrated in Klupfel et al, U.S. Pat. No. 3,180,730 issued Apr. 27, 1965; the polymeric triarylamines described in Fox U.S. Pat. No.

3,240,597 issued Mar. 15, 1966; the triarylamines having at least one of the aryl radicals substituted by either a vinyl radical or a vinylene radical having at least one active hydrogen-containing group as described in Brantly et al, U.S. Pat. No. 3,567,450 issued Mar. 2, 1971; the triarylamines in which at least one of the aryl radicals is substituted by an active hydrogen-containing group as described in Brantly et al, U.S. Pat. No. 3,658,520 issued Apr. 25, 1972; and tritolylamine.

3. polyarylalkane materials of the type described in Noe et al, U.S. Pat. No, 3,274,000 issued Sept. 20, 1966; Wilson, U.S. Pat. No. 3,542,547 issued Nov. 24, 1970; Seus et al, U.S. Pat. No, 3,542,544 issued Nov. 24, 1970, and in Rule et al, U.S. Pat. No. 3,615,402 issued Oct. 26, 1971. Preferred polyarylalkane photoconductors can be represented by the formula:

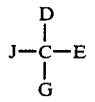

wherein D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed as the charge-transport material is a polyarylalkane having the formula noted above wherein J and E represent a hydrogen atom, an aryl group, or an alkyl group and D and G represent substituted aryl groups having as a substituent thereof a group represented by the formula:

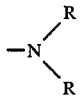

wherein R represents an unsubstituted aryl group such as phenyl or an alkyl substituted aryl such as a tolyl group.

4. strong Lewis base materials such as various aromatic, including aromatically unsaturated heterocyclic-containing, materials which are free of strong electron withdrawing groups. A partial listing of such aromatic Lewis base materials includes tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1-4,bromopyrene, phenylindole, polyvinyl carbazole, polyvinyl pyrene, polyvinyl tetracene, polyvinyl perylene, and polyvinyl tetraphene.

5. other useful p-type charge-transport materials which may be employed in the present invention are any of the p-type organic photoconductors, including metallo-organo materials, known to be useful in electrophotographic processes, such as any of the organic photoconductive materials described in *Research Disclosure,* Vol. 109, May 1973, pages 61–67, paragraph IV (A) (2) through (13) which are p-type photoconductors.

Illustrative n-type organic photoconductive materials include strong Lewis acids such as organic, including metallo-organic, materials containing one or more aromatic, including aromatically unsaturated heterocyclic, materials bearing an electron withdrawing substituent. These materials are considered useful because of their characteristic electron accepting capability. Typical electron withdrawing substituents include cyano and nitro groups; sulfonate groups; halogens such as chlorine, bromine, and iodine; ketone groups; ester groups; acid anhydride groups; and other acid groups such as carboxyl and quinone groups. A partial listing of such representative n-type aromatic Lewis acid materials having electron withdrawing substituents includes phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toluene, 4,6-dichloro-1,3-dinitrobenzene, 4,6-dibromo-1,3-dinitrobenzene, P-dinitrobenzene, chloranil, bromanil, 2,4,7-trinitro-9-fluorenone, 2,4,5,7-tetranitrofluorenone, trinitroanthracene, dinitroacridene, tetracyanopyrene, dinitroanthraquinone, and mixtures thereof.

Other useful n-type charge-transport materials which may be employed in the present invention are conventional n-type organic photoconductors, for example, complexes of 2,4,6-trinitro-9-fluorenone and poly(vinyl carbazole) provide useful n-type charge-transport materials. Still other n-type organic, including metallo-organo, photoconductive materials useful as n-type charge-transport materials in the present invention are any of the organic photoconductive materials known to be useful in electrophotographic processes such as any of the materials described in *Research Disclosure,* Vol. 109, May 1973, pages 61–67, paragraph IV (A) (2) through (13) which are n-type photoconductors. The foregoing Research Disclosure article is incorporated herein by reference thereto.

Particularly preferred charge-transport materials for the purposes of this invention are the polynuclear tertiary aromatic amines, especially those of the formula:

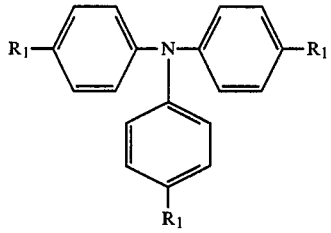

where $R_1$ is hydrogen or alkyl of 1 to 4 carbon atoms, and the triaryl alkanes, especially those of the formula:

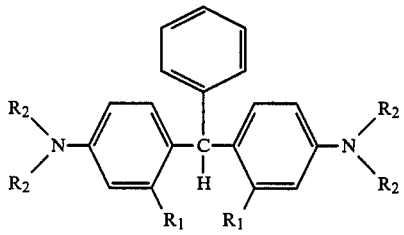

where $R_1$ is hydrogen or alkyl of 1 to 4 carbon atoms and $R_2$ is alkyl of 1 to 4 carbon atoms.

Specific illustrative examples of particularly preferred charge-transport materials for use in the photoconductive elements of this invention include:

triphenylamine
tri-p-tolylamine
1,1-bis(4-di-p-tolylaminophenyl)cyclohexane
4,4'-benzylidene bis(N,N'-diethyl-m-toluidine)
1,1-bis(4-[di-4-tolylamino]phenyl)-3-phenylpropane
1,1-bis(4-[di-4-tolylamino]phenyl)-2-phenylethane
1,1-bis(4-[di-4-tolylamino]phenyl)-2-phenylpropane
1,1-bis(4-[di-4-tolylamino]phenyl-3-phenyl-2-propene
bis(4-[di-4-tolylamino]phenyl)phenylmethane
1,1-bis(4-[di-4-tolylamino]-2-methylphenyl-3-phenylpropane
1,1-bis(4-[di-4-tolylamino]phenyl)propane
2,2-bis(4-[di-4-tolylamino]phenyl)butane
1,1-bis(4-[di-4-tolylamino]phenyl)heptane
2,2-bis(4-[di-4-tolylamino]phenyl)-5-(4-nitrobenzoxy)-pentane and the like.

The charge-transport layer may consist entirely of the charge-transport materials described hereinabove, or, as is more usually the case, the charge-transport layer may contain a mixture of the charge-transport material in a suitable film-forming polymeric binder material. The binder material may, if it is an electrically insulating material, help to provide the charge-transport layer with electrical insulating characteristics, and it also serves as a film-forming material useful in (a) coating the charge-transport layer, (b) adhering the charge-transport layer to an adjacent substrate, and (c) providing a smooth, easy to clean, and wear resistant surface. Of course, in instances where the charge-transport material may be conveniently applied without a separate binder, for example, where the charge-transport material is itself a polymeric material, such as a polymeric arylamine or poly(vinyl carbazole), there may be no need to use a separate polymeric binder. However, even in many of these cases, the use of a polymeric binder may enhance desirable physical properties such as adhesion, resistance to cracking, etc.

Where a polymeric binder material is employed in the charge-transport layer, the optimum ratio of charge-transport material to binder material may vary widely depending on the particular polymeric binder(s) and particular charge-transport material(s) employed. In general, it has been found that, when a binder material is employed, useful results are obtained wherein the amount of active charge-transport material contained within the charge-transport layer varies within the range of from about 5 to about 90 weight percent based on the dry weight of the charge-transport layer.

A partial listing of representative materials which may be employed as binders in the charge-transport layer are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene; isobutylene polymers; polyesters, such as poly[ethylene-co-alkylenebis(alkyleneoxyaryl)phenylenedicarboxylate]; phenolformaldehyde resins; ketone resins; polyamides; polycarbonates, polythiocarbonates; poly[ethylene-co-isopropylidene-2,2-bis(ethyleneoxyphenylene)-terephthalate]; copolymers of vinyl haloarylates and vinyl acetate such as poly(vinyl-m-bromobenzoate-co-vinyl acetate); chlorinated poly(olefins), such as chlorinated poly(ethylene); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the charge transport layers of the invention are sold under such tradenames as VITEL PE-101, CYMAC, Piccopale 100, Saran F-220, and LEXAN 145. Other types of binders which can be used in charge transport layers include such materials as paraffin, mineral waxes, etc., as well as combinations of binder materials.

In general, it has been found that polymers containing aromatic or heterocyclic groups are most effective as the binder materials for use in the charge-transport layers because these polymers, by virtue of their heterocyclic or aromatic groups, tend to provide little or no interference with the transport of charge carriers through the layer. Heterocyclic or aromatic-containing polymers which are especially useful in p-type charge-transport layers include styrene-containing polymers, bisphenol-A polycarbonate polymers, phenolformaldehyde resins, polyesters such as poly[ethylene-co-isopropylidene-2,2,bis(ethyleneoxyphenylene)]terephthalate, and copolymers of vinyl haloarylates and vinylacetate such as poly(vinyl-m-bromobenzoate-co-vinyl acetate).

The charge-transport layer may also contain other addenda such as leveling agents, surfactants, plasticizers, and the like to enhance or improve various physical properties of the charge-transport layer. In addition, various addenda to modify the electrophotographic response of the element may be incorporated in the charge-transport layer.

The novel multi-active photoconductive insulating elements of the present invention can be prepared by a process comprising the steps of:

(1) depositing on an electrically-conductive support a substantially amorphous layer of PPC;

(2) overcoating the substantially amorphous layer with a layer of a liquid composition comprising an organic solvent, a polymeric binder and an organic photoconductive material which is capable of accepting and transporting injected charge-carriers from a charge-generation layer; and (3) effecting removal of the organic solvent from the element.

The functions of the liquid composition are two-fold, namely, (A) to form a charge-transport layer and (B) to penetrate into the amorphous layer and convert the PPC to a crystalline form.

Suitable solvents for use in forming the liquid composition can be selected from a wide variety of organic solvents including, for example, ketones such as acetone or methyl ethyl ketone, hydrocarbons such as benzene or toluene, alcohols such as methanol or isopropanol, halogenated alkanes such as dichloromethane or trichloroethane, esters such as ethyl acetate or butyl acetate, ethers such as ethyl ether or tetrahydrofuran, and the like. Mixtures of two or more of the organic solvents can, of course, be utilized and may be advantageous in certain instances.

Removal of the solvent can be accomplished in any suitable manner, such as by merely allowing it to evaporate at room temperature if a relatively volatile solvent has been employed. More typically, solvent removal is effected in a drying process in which the element is subjected to an elevated temperature while exposed to air or an inert gaseous medium. Drying temperatures are typically in the range of from about 30° C. to about 100° C., and drying times in the range of from a few minutes to a few hours. Conversion of the amorphous PPC to the crystalline form occurs during the coating and drying process and is strongly influenced by the drying rate, as is hereinafter discussed in greater detail.

In the manufacture of the multi-active photoconductive insulating elements of this invention, the amorphous PPC layer is preferably formed by vacuum sublimation. Vacuum sublimation can be effected by placing the PPC in a crucible contained in a vacuum deposition apparatus and positioning a substrate relative to the crucible so that material subliming from the crucible will be deposited upon the substrate. The vacuum chamber is preferably maintained at a pressure of from about $10^{-4}$ to about $10^{-6}$ Torr. The crucible is heated to the minimum temperature consistent with an adequate rate of sublimation of the PPC. Temperatures in the range of from about 250° C. to about 450° C. are preferred. To facilitate formation of an amorphous layer, the substrate is maintained at a temperature at or below room temperature.

While other processes for forming a substantially amorphous layer of PPC such as, for example, sputtering, can also be used, vapor deposition in vacuum is especially beneficial, as it is capable of providing layers which are extremely thin and of an exactly controlled thickness.

The liquid composition containing the organic solvent, the organic photoconductive material and the polymeric binder, can be coated over the amorphous PPC layer by any suitable coating technique, such as, for example, by the use of an extrusion coating hopper, by dip coating, by curtain coating, and the like.

The thickness of the active layers of the multi-active photoconductive insulating elements of this invention can vary widely, as desired. Generally speaking, the charge-transport layer is of much greater thickness than the charge-generation layer. Typically, the charge-generation layer has a thickness in the range of from about 0.005 to about 3.0 microns, and more preferably in the range of from about 0.05 to about 1.0 microns; while the charge-transport layer typically has a thickness in the range of from about 5 to about 100 microns, and more preferably in the range of from about 10 to about 35 microns.

Photoconductive insulating elements having charge-generation layers containing perylene pigments have not achieved widespread commercial acceptance heretofore. It is believed that one of the reasons for this is that the utility of charge-generation layers of this type has heretofore been severely restricted by the fact that such layers frequently exhibit weak, or nonexistent, absorption and sensitivity in the spectral region beyond 600 nm. In marked contrast to the prior art elements containing perylene pigments in charge-generation layers, the novel elements of this invention exhibit panchromatic sensitivity, i.e., a high level of photosensitivity over the whole of the visible spectral region from about 400 to about 700 nm. Thus, the elements of this invention are especially useful in applications where panchromatic sensitivity is required—such as electrophotographic copiers—while those of the prior art typically exhibit inferior performance in such use. Moreover, the elements of this invention can be utilized in applications employing a He-Ne laser exposure source—which requires especially high sensitivity at 633 nm—while those of the prior art typically lack adequate sensitivity for good performance in this use.

A further reason for the prior lack of commercial success of photoconductive insulating elements with a charge-generation layer containing a perylene pigment has been that these elements typically exhibit very low quantum efficiencies. In the elements of this invention, however, the quantum efficiency is greatly improved.

Although perylene pigments have long been known to be useful in electrophotography, the prior art has been unaware of the unique crystalline forms described herein and of the unique combination of high electrophotographic speed, panchromatic sensitivity, low dark decay, and controllable contrast that they provide.

As indicated hereinabove, the charge-generation layer of the novel multi-active photoconductive insulating elements of this invention is characterized by a first spectral absorption peak within the range of 420 to 470 nm and a second spectral absorption peak within the range of 610 to 630 nm. An amorphous layer of PPC exhibits spectral absorption peaks which are not as widely separated as those of the crystalline forms employed in this invention, and the absorption drops off rapidly beyond about 600 nm. Thus, conversion of the amorphous layer to the desired crystalline form results in both a spreading apart of the absorption peaks and an extension of the range of photosensitivity out to at least about 700 nm.

Determination of the spectral absorption characteristics of the charge-generation layer of the novel photoconductive elements of this invention can be carried out in accordance with well known techniques, as described, for example, in Chapter 10 of The Theory Of The Photographic Process, Fourth Edition, Edited by T. H. James, Macmillan Publishing Co., Inc., New York, N.Y. (1977).

As also indicated hereinabove, the charge-generation layer of the novel multi-active photoconductive insulating elements of this invention is characterized by a prominent line at a $2\theta$ angular position within the range of 22 to 25 degrees in the X-ray diffraction pattern obtained with CuK$\alpha$ radiation. The presence of such prominent line serves to distinguish the crystalline forms of PPC utilized in this invention from the amorphous form and from other crystalline forms, such as those exhibited by PPC in the neat state.

Determination of the X-ray diffraction characteristics of the charge-generation layer can be carried out in accordance with well known techniques, as described, for example, in Engineering Solids by T. S. Hutchison and D. C. Baird, John Wiley and Sons, Inc., 1963, and X-Ray Diffraction Procedures For Polycrystalline And Amorphous Materials, 2nd Edition, John Wiley and Sons, Inc., 1974.

An important feature of the present invention is the fact that the contrast of the photoconductive element can be readily controlled by varying the manufacturing conditions. Thus, one is able to prepare a high contrast element for particular uses where such property is especially desirable, for example, photocopying applications limited to line copy, or to prepare a low contrast element for particular uses where such property is especially desirable, for example continuous tone electrophotography that is adaptable to copying of pictorial information. Among the numerous variables in the manufacturing process that can affect the formation of the crystalline forms of PPC and thereby affect such properties as electrophotographic speed, sensitivity range and contrast, the following are particularly significant:

(a) the particular organic photoconductor(s) employed, (b) the particular solvent or solvent mixture employed, (c) the particular polymeric binder(s) employed, (d) the molecular weight of the polymeric binder, (e) whether the PPC is vacuum deposited or dispersion coated, (f) the temperature of vacuum deposition, (g) whether or not the layer of PPC is subjected to a pre-fuming treatment, (h) the concentration of binder and of photoconductor in the solvent solution, and (i) the rate and temperature at which the charge-transport layer is dried.

Factors favoring the formation of a low contrast material, that is, the 23° material, include drying the element at a slow rate after deposition of the charge-transport layer.

Factors favoring the formation of a high contrast material, that is, the 24° material, include drying the element at a rapid rate after deposition of the charge-transport layer.

As used herein, the term "high electrical contrast" is intended to refer to a maximum contrast, when the element is charged to 500 volts, of above 500 V/LogE, the term "low electrical contrast" is intended to refer to a maximum contrast of below 400 V/LogE, and the term "medium electrical contrast" is intended to refer to a maximum contrast in the range of from 400 to 500 V/LogE.

The combinations of particular organic photo-conductors and particular manufacturing conditions that will produce the novel multi-active elements of this invention cannot be easily predicted from theoretical considerations but can be readily determined by experimentation. Several illustrations of useful combinations are provided in the working examples hereinafter described.

The novel multi-active photoconductive insulating elements of this invention can be employed as "single-use" films or as "reusable" films, and can be utilized with a positive polarity surface potential or with a negative polarity surface potential. Single-use films are designed and formulated for a single electrophotographic cycle, while reusable films are designed and formulated to be cycled many times without significant change in their discharge characteristics.

In one preferred embodiment of the invention, the charge-generation layer contains PPC in a crystalline form which imparts high electrophotographic speed, panchromatic sensitivity, and high electrical contrast characteristics to the element. This embodiment is characterized by a charge-generation layer exhibiting spectral absorption peaks at approximately 460 and 620 nm and having a prominent line at the $2\theta$ angular position of 24° in the X-ray diffraction pattern obtained with CuK$\alpha$ radiation. In a second preferred embodiment of the invention, the charge-generation layer contains PPC in a crystalline form which imparts high electrophotographic speed, panchromatic sensitivity, and low electrical contrast characteristics to the element. This embodiment is characterized by a charge-generation layer exhibiting spectral absorption peaks at approximately 430 and 620 nm and having a prominent line at the $2\theta$ angular position of 23° in the X-ray diffraction pattern obtained with CuK $\alpha$ radiation.

By appropriate manipulation of the manufacturing conditions, especially the drying rate, it is possible to form elements with a medium level of contrast, as well as those of high contrast and those of low contrast. Thus, an important advantage of the invention is its versatility in providing controllable contrast.

An amorphous layer of PPC exhibits a major absorption peak at about 497 nm, and two minor absorption peaks at 470 and 543 nm. FIG. 1 represents the spectral absorption curve of an amorphous layer of PPC. A charge-generation layer containing PPC in the crystalline form referred to herein as the 23° form exhibits spectral absorption peaks at approximately 430 and 620 nm, indicating that extensive shifting of the peaks has occurred. Such a layer exhibits a low contrast and a prominent line at the $2\theta$ angular position of 23° in the X-ray diffraction pattern obtained with CuK$\alpha$ radiation. A charge-generation layer containing PPC in the crystalline form referred to herein as the 24° form exhibits high contrast, spectral absorption peaks at approximately 460 and 620 nm and a prominent line at the 20 angular position of 24° in the X-ray diffraction pattern obtained with CuK$\alpha$ radiation.

The molecular size of the organic photoconductor appears to be a significant factor in determining whether or not a 23° or 24° crystalline form is produced within the charge-generation layer. For example, molecules of very large size do not appear to be capable of producing the 23° form.

While the particular crystalline forms of PPC utilized in the present invention are not, to applicants' knowledge, known to the prior art, PPC itself is a known pigment. A typical synthesis of PPC is as follows:

100 grams of 3,4:9,10-perylene tetracarboxylic dianhydride, 70 grams of phenethylamine, and 1,000 milliliters of quinoline were combined in a 2-liter 3-neck flask fitted with a mechanical stirrer, a stopper, and, in the third neck, a 34 centimeter Vigreaux column connected to a Dean Stark trap that is in turn connected to a water condenser. The purpose of the Vigreaux column is to return phenethylamine and quinoline to the reaction flask, while the water that is produced during the reaction is collected in the Dean Stark trap. The reaction mixture was heated at reflux for 5 hours under nitrogen. During this period, 9 milliliters of water was collected in the Dean Stark trap. The reaction product was filtered hot through a 2-liter medium porosity sintered glass filter funnel, washed by slurrying twice with one liter of acetone, twice with one liter of toluene and twice with one liter of acetone, and dried overnight in a vacuum oven (water pump pressure) at 114° C. The product was a black solid and was obtained in an amount of 116.2 grams, which represents a yield of 76.1%.

The multi-active photoconductive insulating elements of the present invention perform exceptionally well in both single use and reusable electrophotographic applications. They are formulated as composite layer structures in order to achieve a high degree of photosensitivity as well as to provide durable physical properties. The interactions which occur between the charge-generation layer and the contiguous layers of the element appear to be highly complex. For example, modifications of the charge-generation layer such as expansion, mixing, complex formation, crystallization, orientation, and spectral absorption shifts are observed after it is overcoated with the charge-transport layer. The layer underlying the charge-generation layer is also important in that it affects not only physical properties but also the quantum efficiency of the photodischarge. The polymeric binder in the coating composition used to form the charge-transport layer serves to form an adhesive bond with the layer underlying the charge-generation layer, and it accomplishes this by diffusing through the charge-generation layer during the overcoating process. This diffusion of the polymeric binder greatly increases the strength of the charge-generation layer, which would otherwise be inadequate for many applications, since the PPC has the consistency of soft clay in the as-deposited state.

It is preferred to employ an adhesive polymer interlayer between the electrically-conductive support and the charge-generation layer, as this provides an element with particularly good physical properties. The interlayer polymer requirements go beyond that of simply providing a good adhesive bond, however, since distortion and/or cracking of the charge-generation layer can occur as a consequence of an interlayer interaction. These defects, which are found to cause a loss of photoresponse and which would also be likely to contribute to electrical noise, are thought to originate from a swelling of the interlayer polymer when the coating solvents in the charge-transport composition diffuse through the charge-generation layer during coating. When the solvents are evaporated during drying, the PPC layer does not return to its original uniformity, but remains in the distorted or cracked configuration. Thus, polymers for use in the interlayer are preferably selected on the basis of both their ability to bond the polymer of the charge-transport composition to the support, and their ability to resist swelling by organic solvents.

An alternative approach to the problem is to incorporate an adhesive polymer in the charge-transport composition which is capable of diffusing through the charge-generation layer to the electrically-conductive surface of the support to thereby provide a good adhesive bond without the need for a separate interlayer. The advantages of this approach are a reduction in the number of coated layers—which is particularly important for single-use applications where manufacturing costs become critical—and the opportunity to vacuum deposit in tandem both the electrically-conductive layer and the charge-generation layer. A particularly useful adhesive polymer for incorporation in a charge-transport composition is poly[ethylene-co-neo-pentyleneterephthalate (55/45)].

When an adhesive interlayer is employed, it is particularly preferred to utilize as the adhesive polymer an acrylonitrile copolymer as described in copending U.S. patent application Ser. No. 643,768, filed Aug. 24, 1984 (as a continuation of application Ser. No. 495,227, filed May 16, 1983, and now abandoned), entitled, "Multilayer Photoconductive Elements Having An Acrylonitrile Copolymer Interlayer," by W. J. Staudenmayer et al, the disclosure of which is incorporated herein by reference. Examples of useful acrylonitrile copolymers disclosed in the aforesaid patent application include:

poly(acrylonitrile-co-n-butyl acrylate),
poly(acrylonitrile-co-vinylidene chloride-co-acrylic acid),
poly(acrylonitrile-co-vinylidene chloride),
poly(acrylonitrile-co-methylacrylate), and
poly(acrylonitrile-co-ethylacrylate).

The invention is further illustrated by the following examples of its practice.

EXAMPLE 1

A multi-active photoconductive insulating element was prepared utilizing PPC as the charge-generating agent and tri-p-tolylamine as the charge-transport agent. The support for the element consisted of a poly(ethylene terephthalate) film coated with a conductive nickel layer that was overcoated with an adhesive interlayer comprised of poly[acrylonitrile-co-vinylidene chloride (15/85)]. In preparing the element, a 0.2 micron thick amorphous layer of PPC was vacuum-deposited over the interlayer by sublimation from a resistance-heated tantalum crucible at a temperature of 410° C., a pressure of $1\times10^{-5}$ Torr, and a crucible to substrate distance of 25 cm. The vacuum-deposited layer was overcoated at a temperature of 15° C. with a solution of an organic photoconductor and a polymeric binder in a solvent mixture, and then oven dried for 1 hour at 60° C. The solution used to form the overcoat contained 12% by weight solids consisting of 60% by weight of the binder bisphenol-A-polycarbonate and 40% by weight of the organic photoconductor tri-p-tolylamine and was coated in an amount sufficient to provide a dry layer thickness of 11 microns. The solvent was a mixture of 60% by weight dichloromethane and 40% by weight 1,1,2-trichloroethane. The thickness of the PPC layer increased by about 85% as a result of the overcoating with the composition utilized to form the charge-transport layer.

Figure 2:
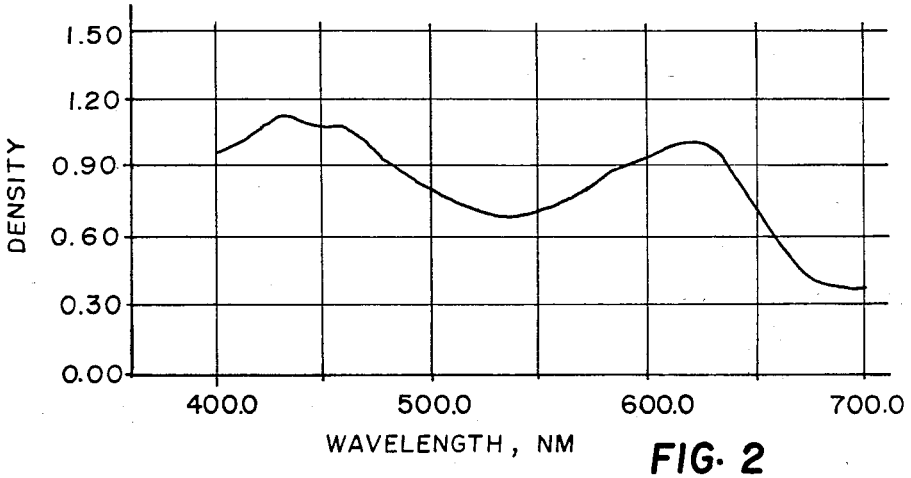
FIG. 2 is a plot of the spectral absorption curve of a charge-generation layer containing N,N'-bis(2-phenethyl)perylene-3,4:9,10-bis(dicarboximide) in a crystalline form that is characterized by low electrical contrast.
Figure 4:
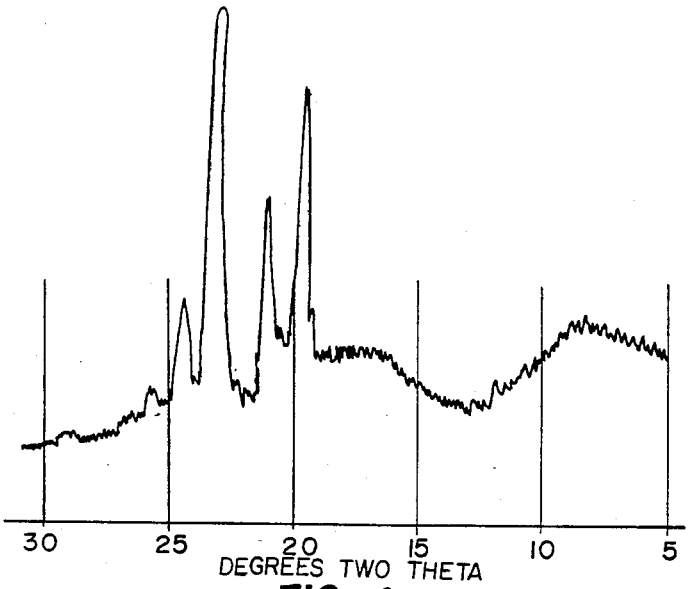
FIG. 4 is a plot of the X-ray diffraction pattern of the charge-generation layer of FIG. 2.
Figure 6:
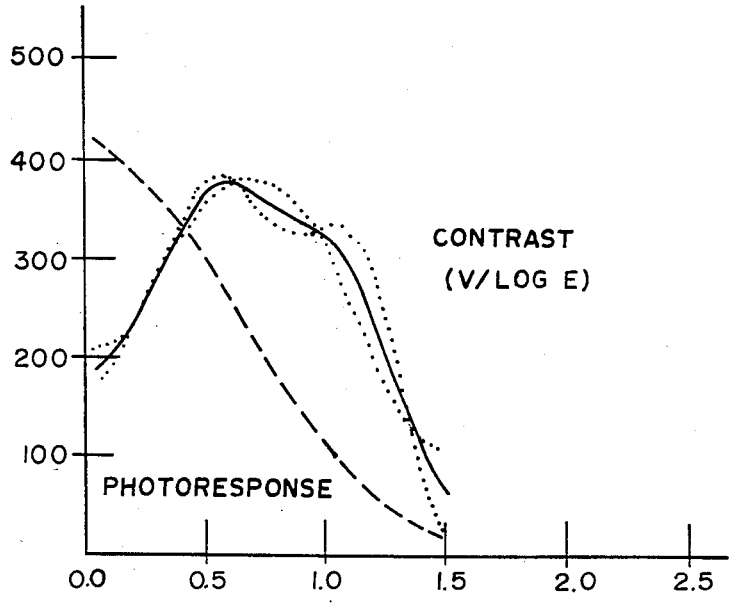
FIG. 6 is a V-logE plot for a low contrast photoconductive element having the spectral absorption and X-ray diffraction characteristics shown, respectively, in FIGS. 2 and 4.

Preparation of the element in the manner described above resulted in formation of a crystalline form of PPC of the type referred to hereinabove as the 23° form. The element was a low contrast element exhibiting at an initial voltage of 500 volts a maximum contrast (V/logE) of 380, and a 1.25 logE exposure range in the interval between 425 and 50 volts. (The exposure source being a 160 microsecond Xenon-filled flash lamp that was filtered to include only the radiation between 400 and 700 nm, and the $V_o$ being 500 volts.) The spectral absorption curve of the charge-generation layer of this element is shown in FIG. 2, while the X-ray diffraction pattern is shown in FIG. 4. As indicated by these figures, the charge-generation layer exhibits panchromatic sensitivity, spectral absorption peaks at approximately 430 and 620 nm, and a prominent line at the $2\theta$ angular position of 23° in the X-ray diffraction pattern obtained with CuK $\alpha$ radiation. (The diffraction pattern was obtained on a Siemens Type F diffractometer equipped with a diffracted beam monochromator). The V-logE curve for the element is shown in FIG. 6. The element had a quantum efficiency (charge pairs neutralized at onset of photodischarge per incident photon) of 0.43 and required an exposure of only 7.8 ergs/cm$^2$ at 630 nm to discharge from 500 to 100 volts, thereby indicating that it had very high electrophotographic speed. It also exhibited the highly desirable characteristic of a very low dark-decay rate.

An analysis of the element was carried out to determine the extent to which the components of the charge-transport layer had penetrated into the charge-generation layer. In this analysis, a thin section of the element was irradiated with a laser beam that ejects fragments which are detected in a mass spectrometer. The analysis indicated that the concentration of tri-p-tolylamine in the charge-generation layer was approximately half that in the charge-transport layer, while the concentration of bisphenol-A-polycarbonate in the charge-generation layer was approximately the same as in the charge-transport layer.

EXAMPLE 2

Figure 3:
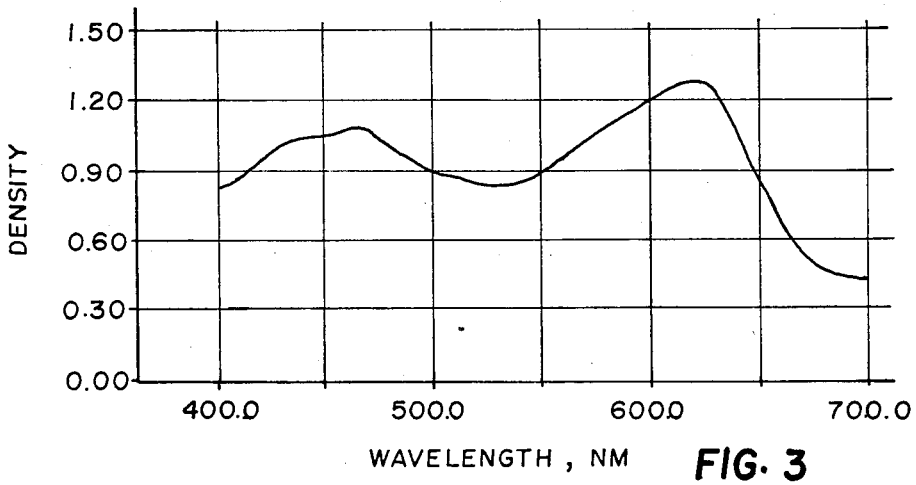
FIG. 3 is a plot of the spectral absorption curve of a charge-generation layer containing N,N'-bis(2-phenethyl)perylene-3,4:9,10-bis(dicarboximide) in a crystalline form that is characterized by high electrical contrast.
Figure 5:
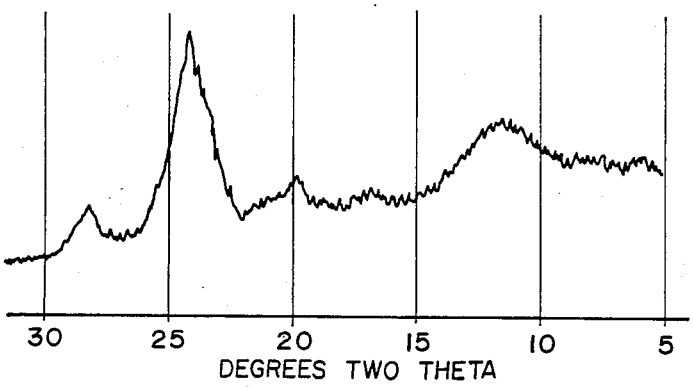
FIG. 5 is a plot of the X-ray diffraction pattern of the charge-generation layer of FIG. 3.
Figure 7:
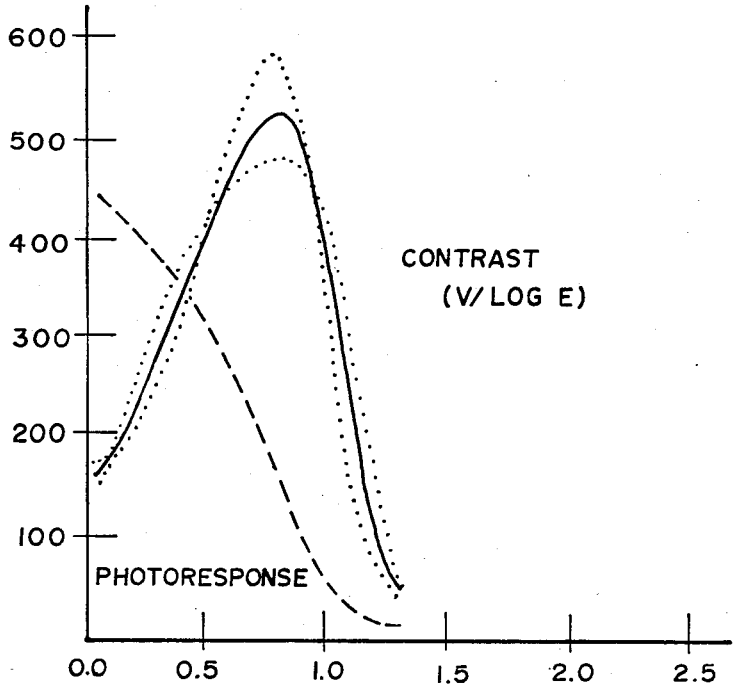
FIG. 7 is a V-logE plot for a high contrast photoconductive element having the spectral absorption and X-ray diffraction characteristics shown, respectively, in FIGS. 3 and 5.

A multi-active photoconductive insulating element was prepared in the same manner as in Example 1 using the same materials except that the organic solvent consisted entirely of dichloromethane. Preparation of the element in this manner resulted in formation of a crystalline form of PPC of the type referred to hereinbefore as the 24° form. The element was a high contrast element exhibiting at an initial voltage of 500 volts a maximum contrast (V/logE) of 530 and a 0.95 logE exposure range in the interval between 425 and 50 volts. The spectral absorption curve of the charge-generation layer of this element is shown in FIG. 3, while the X-ray diffraction pattern is shown in FIG. 5. As indicated by these figures, the charge-generation layer exhibits panchromatic sensitivity, spectral absorption peaks at approximately 460 and 620 nm, and a prominent line at the $2\theta$ angular position of 24° in the X-ray diffraction pattern obtained with CuK $\alpha$ radiation. The V-logE curve for this element is shown in FIG. 7. The element exhibited a very low dark-decay rate, had a quantum efficiency of 0.46 and required an exposure of only 4.7 ergs/cm$^2$ at 630 nm to discharge from 500 to 100 volts, thereby indicating that it had very high electrophotographic speed.

The difference in crystalline form in the element described above, as compared to that of Example 1, is attributable to the major difference in the boiling points of the solvents and the correspondingly major difference in drying rates. The mixed solvent composition of Example 1, which has a boiling point of 114° C., would allow more time for penetration of the PPC layer by the components of the charge-transport layer, as well as more time for crystal growth, as compared to the dichloromethane solvent which has a boiling point of only 40° C.

When the procedure of Example 1 was repeated except for being modified as indicated below, the 23° form was produced:

(a) when the tri-p-tolylamine was replaced with triphenylamine, (b) when the tri-p-tolylamine was replaced with 4,4'-benzylidene bis(N,N'-diethyl-m-toluidine), and (c) when the bisphenol-A-polycarbonate was replaced with poly[4,4'-(2-norbornylidene)diphenylene azelate-co-terephthalate (40/60)].

When the procedure of Example 1 was repeated except for being modified as indicated below, the 24° form was produced:

(a) when the tri-p-tolylamine was omitted from the composition, and (b) when the tri-p-tolylamine was replaced with 1,1-bis(4-di-p-tolylaminophenyl)cyclohexane.

When the procedure of Example 1 was repeated except for being modified as indicated below, neither the 23° form nor the 24° form was produced:

(1) when the polymeric binder was omitted from the coating composition, (2) when both the polymeric binder and the organic photoconductor were omitted from the coating composition, and (3) when the PPC was dispersed in a medium containing cellulose nitrate and isopropanol and the resulting dispersion coated on the substrate to form a charge-generation layer.

While conditions (1) to (3) above did not result in the formation of either the 23° or 24° forms, they did result in the formation of crystalline forms of PPC; but, in each case, the X-ray diffraction pattern of the resulting charge-generation layer displayed a prominent line at a $2\theta$ angular position of about 6 degrees and did not display a prominent line at a $2\theta$ angular position in the range of 22 to 25 degrees and the element did not exhibit panchromatic sensitivity and/or exhibited an electrophotographic speed that was greatly inferior to that of the elements of Examples 1 and 2.

When PPC was dispersed in a mixture of 60% by weight dichloromethane and 40% by weight 1,1,2-trichloroethane, dried for one hour at 60° C., and subjected to X-ray diffraction examination, the result was a diffraction pattern having a prominent line at the $2\theta$ angular position of 6°. The same diffraction pattern was obtained when the test was repeated, except that tri-p-tolylamine was included in the dispersion. The same diffraction pattern was also obtained when the test was repeated, except that bisphenol-A-polycarbonate and tri-p-tolylamine were included in the dispersion. Thus, the preparation of a dispersion of PPC is not a useful technique for obtaining the novel multi-active photoconductive insulating elements of this invention.

It is thus apparent that variation in any of numerous parameters in the manufacturing process—especially the drying rate and the size and structure of the organic photoconductive material employed in the charge-transport layer—can influence the particular crystalline form of PPC that is created in the charge-generation layer and, accordingly, can influence the electrophotographic characteristics of the photoconductive element. Thus, experimentation may be necessary to determine whether a particular photoconductor can be utilized to form a photoconductive insulating element within the scope of the present invention and, if so, to establish the optimum manufacturing conditions.

As shown by Examples 1 and 2 above, multi-active elements prepared in accordance with the teachings provided herein exhibit panchromatic sensitivity, very high electrophotographic speed, low dark decay, and controllable contrast. For purposes of comparison with these examples, multi-active elements were prepared in accordance with the working examples of Regensburger et al, U.S. Pat. No. 3,904,407. In a first element, which was prepared in accordance with Example 1 of U.S. Pat. No. 3,904,407, the perylene pigment was a para-chloro-aniline-perylene, and poly N-vinyl carbazole was utilized as the photoconductive material in the charge-transport layer. In this element, the charge-generation layer did not exhibit a prominent line in the range of 22 to 25 degrees, but did exhibit a prominent line at 14.4 degrees. The element would accept a maximum initial charge of only 350 volts, and required an exposure at 580 nm of greater than 25 ergs/cm$^2$ to discharge to 100 volts. In a second element, which was prepared in accordance with Example 2 of U.S. Pat. No. 3,904,407, the perylene pigment was a para-methoxyaniline perylene and poly N-vinyl carbazole was utilized as the photoconductive material in the charge-transport layer. In this element, the charge-generation layer did not exhibit a prominent line at any position. The element would accept a maximum initial charge of only 300 volts, and required an exposure at 580 nm of greater than 40 ergs/cm$^2$ to discharge to 100 volts.

To provide further comparison, an element was prepared in the same manner as in Example 1 of U.S. Pat. No. 3,904,407, except that the perylene pigment was a para-ethoxy-aniline-perylene. In this element, the charge-generation layer did not exhibit a prominent line at any position. The element would accept a maximum initial charge of only 400 volts, and required an exposure at 580 nm of greater than 45 ergs/cm$^2$ to discharge to 100 volts.

It is the crystalline structure of the PPC that is a critical novel feature of the present invention which accounts in significant part for its superior performance characteristics. In the prior art relating to multi-active photoconductive insulating elements prepared from perylene pigments, there are some references to the significance of crystalline structure. Thus, for example, Graser et al refer in European Patent Application No. 0 061 088 to differences in the performance of red pigments and black pigments as regards the range of spectral sensitivity. However, Graser et al specify that the sub-class of perylene pigments they disclose—which includes PPC—are to be dispersed in a solvent, alone or together with a binder, and coated on an electrically-conductive support to form an electrophotographic element. As indicated by the comparative examples included herein, this procedure does not yield a material characterized by the crystalline forms described herein, nor provide the advantageous electrophotographic characteristics provided by the present invention.

In German patent application No. 3 019 326, Wiedemann describes the use of the so-called "dark crystal modification" of N,N'-bis(3-methoxypropyl)perylene-3,4:9,10-tetracarboxylic acid diimide to form a charge-generation layer with panchromatic sensitivity. However, Wiedemann did not achieve the very high electrophotographic speeds which are characteristic of the present invention. Thus, for example, Wiedemann reports in German patent application No. 3 019 326 that the $E_{\frac{1}{2}}$ values of his products (exposure required to discharge the element to a voltage equal to one-half of the initial voltage) ranged from 1.8 to 15.5 microjoules/cm$^2$ (18 to 155 ergs/cm$^2$). This indicates much lower electrophotographic speed than in the present invention in which the $E_{\frac{1}{2}}$ value for the element of Example 1 is only 2.6 ergs/cm$^2$ and that for the element of Example 2 is only 2.4 ergs/cm$^2$.

In addition to providing very high electrophotographic speed and panchromatic sensitivity, the present invention provides the ability to effectively control the electrical contrast; whereas the prior art relating to multi-active photoconductive elements prepared from perylene pigments provides no teachings that would enable the highly desirable feature of contrast control to be achieved.

In summary, the novel multi-active photoconconductive insulating elements of this invention exhibit:

(1) panchromatic sensitivity, (2) a high quantum efficiency, typically a quantum efficiency of at least 0.3 or more, (3) low electrical noise, (4) a very low dark-decay rate.

(5) ability to accept a high surface charge, typically a charge of at least 500 volts, (6) very high electrophotographic speed, typically a speed such that an exposure, at the wavelength of maximum photosensitivity, of not more than 15 ergs/cm$^2$, and usually of not more than 10 ergs/cm$^2$, is required to discharge the element from a surface charge of 500 volts to a surface charge of 100 volts.

(7) a first spectral absorption peak within the range of 420 to 470 nm and a second spectral absorption peak within the range of 610 to 630 nm, and (8) a prominent line at a $2\theta$ angular position within the range of 22 to 25 degrees in the X-ray diffraction pattern obtained with CuK $\alpha$ radiation.

This highly desirable combination of characteristics can be achieved by interaction between a charge-generation layer comprising amorphous PPC and a charge-transport layer which is applied thereover so as to result in the formation of a crystalline form of PPC. This is an especially convenient means of forming the element. The charge-generation layer and charge-transport layer resulting from such a process co-act to provide the photoconductive insulating element with the desired combination of very high electrophotographic speed and panchromatic sensitivity.

The ability provided by this invention to control the contrast of the photoresponse by manipulation of the crystalline state of the emitter—that is, the PPC—provides a valuable tool to achieve improved image quality. The high quantum efficiency attainable with the crystalline forms described herein provides an opportunity to formulate sensitive photoreceptors with low background color for single use applications, as well as reusable high speed photoreceptors with thicker emitter layers for copier applications.

The invention has been described in detail with particular reference to preferred embodiments thereof, but it will be understood that variations and modifications can be effected within the spirit and scope of the invention.

We claim:

1. A multi-active photoconductive insulating element exhibiting very high electrophotographic speed and panchromatic sensitivity;

said element having at least two active layers comprising a charge-generation layer in electrical contact with a charge-transport layer;

said charge-generation layer:

(a) containing a crystalline form of N,N'-bis(2-phenethyl) perylene-3,4:9,10-bis-(dicarboximide) which is capable, upon exposure to activating radiation, of generating and injecting charge carriers into said charge-transport layer, (b) exhibiting a first spectral absorption peak within the range of 420 to 470 nm and a second spectral absorption peak within the range of 610 to 630 nm, and (c) having a prominent line at a $2\theta$ angular position within the range of 22 to 25 degrees in the X-ray diffraction pattern obtained with CuK$\alpha$ radiation; and said charge-transport layer being an organic composition comprising, as a charge-transport agent, an organic photoconductive material which is capable of accepting and transporting injected charge carriers from said charge-generation layer.

2. A photoconductive element as claimed in claim 1 wherein said first spectral absorption peak is at approximately 430 nm, said second spectral absorption peak is at approximately 620 nm, and said prominent line is at 23 degrees; said element exhibiting low electrical contrast.

3. A photoconductive element as claimed in claim 1 wherein said first spectral absorption peak is at approximately 460 nm, said second spectral absorption peak is at approximately 620 nm, and said prominent line is at 24 degrees; said element exhibiting high electrical contrast.

4. A photoconductive element as claimed in claim 1 wherein said organic photoconductive material is a polymeric material.

5. A photoconductive element as claimed in claim 1 wherein said organic photoconductive material is a monomeric material and the organic composition forming said charge-transport layer additionally contains a polymeric binder.

6. A photoconductive element as claimed in claim 5 wherein said polymeric binder is a polycarbonate.

7. A photoconductive element as claimed in claim 5 wherein said polymeric binder is a polyester.

8. A photoconductive element as claimed in claim 1 wherein said organic photoconductive material is an arylamine.

9. A photoconductive element as claimed in claim 1 wherein said organic photoconductive material is a polyarylalkane.

10. A photoconductive element as claimed in claim 1 wherein said organic photoconductive material is a polynuclear tertiary aromatic amine.

11. A photoconductive element as claimed in claim 1 wherein said organic photoconductive material is triphenylamine.

12. A photoconductive element as claimed in claim 1 wherein said organic photoconductive material is tri-p-tolylamine.

13. A photoconductive element as claimed in claim 1 wherein said organic photoconductive material is 4,4'-benzylidene-bis-(N,N'-diethyl-m-toluidine).

14. A photoconductive element as claimed in claim 1 wherein said organic photoconductive material is 1,1-bis(4-di-p-tolylaminophenyl)cyclohexane.

15. A photoconductive element as claimed in claim 1 additionally comprising an electrically-conductive support and an adhesive interlayer between said support and said charge-generation layer.

16. A multi-active photoconductive insulating element exhibiting very high electrophotographic speed, panchromatic sensitivity, and low contrast, said element having at least two active layers comprising a charge-generation layer in electrical contact with a charge-transport layer;

said charge-generation layer:

(a) containing a crystalline form of N,N'-bis(2-phenethyl)perylene-3,4:9,10-bis-(dicarboximide) which is capable, upon exposure to activating radiation, of generating and injecting charge carriers into said charge-transport layer, (b) exhibiting a first spectral absorption peak at approximately 430 nm and a second spectral absorption peak at approximately 620 nm, and (c) having a prominent line at a $2\theta$ angular position of 23 degrees in the X-ray diffraction pattern obtained with CuK $\alpha$ radiation; and said charge-transport layer being an organic composition comprising a polymeric binder and, as a charge-transport agent, a polynuclear tertiary aromatic amine which is capable of accepting and transporting injected charge carriers from said charge-generation layer.

17. A multi-active photoconductive insulating element exhibiting very high electrophotographic speed, panchromatic sensitivity, and high contrast;

said element having at least two active layers comprising a charge-generation layer in electrical contact with a charge-transport layer;

said charge-generation layer:

(a) containing a crystalline form of N,N'-bis(2-phenethyl) perylene-3,4:9,10-bis-(dicarboximide) which is capable, upon exposure to activating radiation, of generating and injecting charge carriers into said charge-transport layer, (b) exhibiting a first spectral absorption peak at approximately 460 nm and a second spectral absorption peak at approximately 620 nm, and (c) having a prominent line at a $2\theta$ angular position of 24 degrees in the X-ray diffraction pattern obtained with CuK$\alpha$ radiation; and said charge-transport layer being an organic composition comprising a polymeric binder and, as a charge-transport agent, a polynuclear tertiary aromatic amine which is capable of accepting and transporting injected charge carriers from said charge-generation layer.

18. A multi-active photoconductive insulating element exhibiting very high electrophotographic speed, panchromatic sensitivity, and low contrast;

said element having at least two active layers comprising a charge-generation layer in electrical contact with a charge-transport layer;

said charge-generation layer:

(a) containing a crystalline form of N,N'-bis(2-phenethyl) perylene-3,4:9,10-bis-(dicarboximide) which is capable, upon exposure to activating radiation, of generating and injecting charge carriers into said charge-transport layer, (b) exhibiting a first spectral absorption peak at approximately 430 nm and a second spectral absorption peak at approximately 620 nm, and (c) having a prominent line at a $2\theta$ angular position of 23 degrees in the X-ray diffraction pattern obtained with CuK $\alpha$ radiation; and said charge-transport layer being an organic composition, comprising bisphenol-A-polycarbonate and tri-p-tolylamine, which is capable of accepting and transporting injected charge carriers from said charge-generation layer.

19. A multi-active photoconductive insulating element exhibiting very high electrophotographic speed, panchromatic sensitivity and high contrast, said element having at least two active layers comprising a charge-generation layer in electrical contract with a charge-transport layer;

said charge-generation layer:

(a) containing a crystalline form of N,N'-bis(2-phenethyl)perylene-3,4:9,10-bis-(dicarboximide) which is capable, upon exposure to activating radiation, of generating and injecting charge carriers into said charge-transport layer, (b) exhibiting a first spectral absorption peak at approximately 460 nm and a second spectral absorption peak at approximately 620 nm, and (c) having a prominent line at a $2\theta$ angular position of 24 degrees in the X-ray diffraction pattern obtained with CuK $\alpha$ radiation; and said charge-transport layer being an organic composition, comprising bisphenol-A-polycarbonate and tri-p-tolylamine, which is capable of accepting and transporting injected charge carriers from said charge-generation layer.

20. A multi-active photoconductive insulating element that is useful in an electrophotographic process; said element:

(a) having at least two active layers comprising a charge-generation layer in electrical contact with a charge-transport layer, (b) exhibiting panchromatic sensitivity, (c) being capable of accepting an electrostatic surface charge of at least 500 volts, and (d) having a very high electrophotographic speed such that an exposure, at the wavelength of maximum photosensitivity, of not more than 15 ergs/cm$^2$ is required to discharge the element from a surface charge of 500 volts to a surface charge of 100 volts;

said charge-generation layer:

(a) containing a crystalline form of N,N'-bis(2-phenethyl)perylene-3,4:9,10-bis(dicarboximide) which is capable, upon exposure to activating radiation, of generating and injecting charge carriers into said charge-transport layer, (b) exhibiting a first spectral absorption peak within the range of 420 to 470 nm and a second spectral absorption peak within the range of 610 to 630 nm, and (c) having a prominent line at a $2\theta$ angular position within the range of 22 to 25 degrees in the X-ray diffraction pattern obtained with CuK $\alpha$ radiation; and said charge-transport layer being an organic composition comprising, as a charge-transport agent, an organic photoconductive material which is capable of accepting and transporting injected charge carriers from said charge-generation layer.

21. A photoconductive element as claimed in claim 1 having a spectral absorption curve substantially as shown in FIG. 2 and an X-ray diffraction pattern substantially as shown in FIG. 4.

22. A photoconductive element as claimed in claim 1 having a spectral absorption curve substantially as shown in FIG. 3 and an X-ray diffraction pattern substantially as shown in FIG. 5.

* * * * *